US006503386B2

(12) United States Patent
Lehmann et al.

(10) Patent No.: US 6,503,386 B2
(45) Date of Patent: Jan. 7, 2003

(54) PROCESS FOR THE PRODUCTION OF ALKALI METAL- AND AMMONIUM PEROXODISULFATE

(75) Inventors: Thomas Lehmann, Langenselbold; Patrik Stenner, Hanau, both of (DE)

(73) Assignee: Degussa AG, Dusseldorf (DE)

( * ) Notice: Subject to any disclaimer, the term of this patent is extended or adjusted under 35 U.S.C. 154(b) by 0 days.

(21) Appl. No.: 09/825,352

(22) Filed: Apr. 4, 2001

(65) Prior Publication Data

US 2002/0014418 A1 Feb. 7, 2002

(30) Foreign Application Priority Data

Apr. 20, 2000 (DE) ..... 100 19 683.7

(51) Int. Cl.[7] ..... C25B 1/28
(52) U.S. Cl. ..... 205/471; 205/472
(58) Field of Search ..... 205/471, 472

(56) References Cited

U.S. PATENT DOCUMENTS

| | | | | |
|---|---|---|---|---|
| 4,144,144 A | | 3/1979 | Radimer et al. | |
| 4,802,959 A | * | 2/1989 | Lipsztajn | 205/472 |
| 5,082,543 A | | 1/1992 | Gnann et al. | |
| 6,214,197 B1 | | 4/2001 | Kimizuka et al. | |

FOREIGN PATENT DOCUMENTS

| | | |
|---|---|---|
| DE | 27 57 861 | 9/1987 |
| DE | 199 13 820 | 10/1999 |
| DE | 199 62 672 | 6/2001 |
| EP | 0 428 171 | 11/1990 |
| WO | WO 01/25508 | 4/2001 |

OTHER PUBLICATIONS

English language abstract of LR above.
English language abstract of MR above.
Michaud et al. "Preparation of peroxodisulfuric acid using boron–doped diamond thin film electrodes", Electrochemical and Solid–State Letters, 3(2) p. 77–79, (2000). No Month.
Dialog Accession No. 12767066, English language abstract of document KR.
Dialog Accession No. 2035136, English language abstract of document LR.
Dialog Accession No. 8646159, English language abstract of document MR.

* cited by examiner

*Primary Examiner*—Arun S. Phasge
(74) *Attorney, Agent, or Firm*—Pillsbury Winthrop LLP

(57) ABSTRACT

The invention relates to a process for the production of a peroxodisulfate, such as ammonium-, sodium- and potassium peroxodisulfate by anodic oxidation of an electrolyte containing a sulfate and/or hydrogen sulfate. The disadvantages of the conventional platinum anodes used for this hitherto can be avoided by using as the anode a diamond film mounted on a conductive carrier and made conductive by doping with a tri- or pentavalent element and by not adding a promoter to the anolyte.

10 Claims, 1 Drawing Sheet

PROCESS FOR THE PRODUCTION OF ALKALI METAL- AND AMMONIUM PEROXODISULFATE

The invention relates to a process for the production of alkali metal-, in particular sodium- and potassium- and of ammonium peroxodisulfate by anodic oxidation of an aqueous solution containing an alkali metal- or ammonium sulfate or -hydrogen sulfate.

The production of alkali metal- and ammonium peroxodisulfate by anodic oxidation of an aqueous solution containing the corresponding sulfate or hydrogen sulfate and the recovery of the salt from the anolyte by crystallisation is known.

According to DE-PS 27 57 861, sodium peroxodisulfate is produced with a current efficiency of 70 to 80% in an electrolytic cell with a cathode protected by a diaphragm and a platinum anode, by electrolysing a neutral aqueous anolyte solution with a starting content of 5 to 9 wt. % sodium ions, 12 to 30 wt. % sulfate ions, 1 to 4 wt. % ammonium ions, 6 to 30 wt. % peroxodisulfate ions and a potential-increasing agent, known as a promoter, such as in particular thiocyanate, using a sulfuric acid solution as the catholyte at a current density of at least 0.5 to 2 A/cm$^2$. After crystallising out and separating of peroxodisulfate from the anolyte, the mother liquor is mixed with the cathode product, neutralised and returned to the anode. The disadvantages of this process are firstly the necessity of using a promoter to reduce the formation of oxygen, secondly the need for a higher current density and thus a high anode potential to obtain an economically viable current efficiency and thirdly the problems associated with the production of the platinum anode of obtaining an acceptable current efficiency for industrial purposes and a long anode lifetime.

A filter-press type electrolytic cell for the production of peroxo compounds, including ammonium peroxodisulfate, sodium peroxodisulfate and potassium peroxodisulfate is known from EP-B 0 428 171. Here, platinum films applied to a valve metal with a hot isostatic press are used as anodes. A solution of the corresponding sulfate containing a promoter and sulfuric acid is used as the anolyte. This process too has the problems referred to above.

In the process of DE-OS 199 13 820, peroxodisulfates are produced by anodic oxidation of an aqueous solution containing neutral ammonium sulfate. To produce sodium- or potassium peroxodisulfate, the solution obtaining [sic] from anodic oxidation, which contains ammonium peroxodisulfate, is reacted with sodium- or potassium hydroxide solution; after crystallisation and separation of the corresponding alkali metal peroxodisulfate, the mother liquor is recycled in mixture with the catholyte produced during electrolysis. Here too, electrolysis is carried out in the presence of a promoter at a platinum electrode as the anode.

Although for many decades peroxodisulfate has been recovered on an industrial scale by anodic oxidation at a platinum anode, there are still serious disadvantages associated with these processes:

Polarisers, also called promoters, must always be added to increase oxygen overvoltage and improve current efficiency; Oxidation products of these promoters penetrate the anode waste gas as toxic substances and must be removed by gas washing.

The anodes, the entire surface of which is normally coated with platinum, always require a high current density. This results in a high current loading of the anolyte volume, the separator and the cathode which necessitates additional measures, for reducing the cathodic current density by three-dimensional structuring and activation. There is also high thermal loading of the labile peroxodisulfate solution. To minimise this loading, structural measures must be taken and the cooling costs also increase. The electrode surface must be limited as a result of the restrictive dissipation of heat, and this increases the installation costs per cell unit. To overcome the high current loading, electrode support materials with good heat transfer properties must generally also be used, and these are susceptible to corrosion and costly.

In Electro Chemical and Solid-State letters, 3(2) 77–79 (2000), P. A. Michaud et. al. disclose the production of peroxodisulfuric acid by anodic oxidation of sulfuric acid using a diamond thin-film electrode doped with boron. This document discloses that such electrodes have a higher overvoltage for oxygen than platinum electrodes, but it is not possible to deduce from this document whether diamond thin-film electrodes doped with boron can also be used for industrial production of ammonium- and alkali metal peroxodisulfates. It is known that sulfuric acid on the one hand and hydrogen sulfates, in particular neutral sulfates, on the other behave very differently during anodic oxidation. In spite of the higher overvoltage of oxygen at diamond electrodes doped with boron, the main subsidiary reaction in addition to anodic oxidation of sulfuric acid is the formation of oxygen and additionally ozone.

The object of the present invention is to demonstrate an industrial process for the production of ammonium- and alkali metal peroxodisulfates, in which the disadvantages of the known processes are at least reduced. It was found, surprisingly, that it is possible to produce ammonium- and alkali metal peroxodisulfates with high current efficiency, by using as the anode a diamond thin-film electrode doped with a tri- or pentavalent element. Surprisingly, promotors can be omitted completely and electrolysis can be carried out at low current density, which produces further advantages.

Accordingly, the present invention relates to a process for the production of a peroxodisulfate of the series ammonium-, sodium- and potassium peroxodisulfate, by anodic oxidation of an aqueous electrolyte containing a salt of the series ammonium-, sodium- and potassium sulfate and/or the corresponding hydrogen sulfate, in an electrolytic cell comprising at least one anode, one cathode and one anolyte area, this being separated by a separator from a catholyte area, or adjoining a gas diffusion cathode, characterised in that a diamond film mounted on a conductive carrier and made conductive by doping with a tri- or pentavalent element is used as the anode and no promoter is added to the anolyte. The subclaims relate to preferred embodiments of this process.

When producing the conductive diamond film which acts as an anode it is doped with one or more tri- or pentavalent elements until it has been doped with a sufficient quantity to ensure adequate conductivity. The doped diamond film is thus an n-type conductor or a p-type conductor. It is useful for the conductive diamond film to be mounted on a conductive carrier material, which can be selected from the series silicon, germanium, titanium, zirconium, niobium, tantalum, molybdenum and tungsten and carbides of these elements. Alternatively, a conductive diamond film can also be applied to aluminium. Particularly preferred carrier materials for the diamond film are silicon, titanium, niobium, tantalum and tungsten and carbides of these elements.

A particularly suitable electrode material for the anode is a boron-doped diamond thin film on silicon.

The diamond electrodes can be produced by two special CVD processes (chemical vapor deposition technic [sic]). They are microwave-plasma CVD and high-wire CVD. In both cases, the gas phase which is activated to plasma by microwave radiation or thermally by hot wires, is formed from methane, hydrogen and optionally other additives, in particular a gaseous compound of the doping agent. By using a boron compound, such as trimethyl boron, a p-type semiconductor is formed. Using a gaseous phosporus compound as a doping agent produces an n-type semiconductor. Depositing the doped diamond film on crystalline silicon produces a particularly dense and pore-free film—a film thickness of approximately 1 $\mu$m is normally sufficient. As an alternative to depositing the diamond film on a crystalline material, it can also be deposited on a self-inhibiting material such as titanium, tantalum, tungsten or niobium. For production of a particularly suitable boron-doped diamond film on a silicon monocrystal, see the previously mentioned article by P. A. Michaud.

Ammonium and sodium peroxodisulfate can be produced in conventional electrolytic cells, which can also be collected in the form of a filter pack. Here, the anode and cathode areas are separated by a separator. The separator can for example be a conventional porous material produced from an oxidic material, but is preferably an ion exchange membrane. Materials which are already known in the prior art, such as lead, carbon, tin, zirconium, platinum, nickel and alloys thereof, preferably lead, are suitable as cathodes.

According to an alternative embodiment of the electrolytic cell, the cathode is in the form of a gas diffusion electrode, and the cathode is provided with an oxygen-containing gas. Electrolysis can thus be carried out at considerably lower cell voltages, which saves a considerable amount of energy. In this case there is no need for a separate anolyte circuit or a microporous or ion exchanging separator, which simplifies the whole process considerably and represents a significant technical improvement on all processes known hitherto.

According to a preferred embodiment, the electrolytic cell comprises a circuit for the liquid anolyte and another circuit for a liquid catholyte. According to the invention the anolyte can be sulfur-acid or neutral and contains ammonium- and/or alkali metal cations, sulfate- and /or hydrogen sulfate anions, preferably also peroxodisulfate anions, but no polariser. In principle, the anolyte composition can correspond to those referred to in the documents of the prior art cited at the beginning, the difference being however, that no promoter is added or is otherwise present.

For the production of ammonium peroxodisulfate, the starting anolyte preferably contains, per litre, 300 to 500 g ammonium sulfate and 0 to 0.2 mol sulfuric acid per mol ammonium sulfate. A substantially neutral starting anolyte is preferred. In this case the catholyte is a sulfur-acid ammonium sulfate solution. It is useful to carry out the anodic oxidation at an anodic current density in the range 50 to 1000 mA/cm$^2$, preferably 400 to 900 mA/cm$^2$. Ammonium peroxodisulfate is recovered in the known way from an anolyte stream washed out from the anolye circuit, processing preferably comprising vacuum crystallisation and separation of the crystals from the mother liquor. The anolyte mother liquor is recirculated for electrolysis after increasing the content of ammonium sulfate or ammonium hydrogen sulfate which can be done by mixing it with the catholyte produced and adding a base as required.

Sodium peroxodisulfate can be recovered either immediately after anodic oxidation of an anolyte containing sodium hydrogen sulfate, the anolyte preferably containing 500 to 600 g $NaHSO_4$ per liter. In this case an aqueous solution containing 300 to 400 g $H_2SO_4$ per liter and 300 to 500 g $Na_2SO_4$ per liter is used as the catholyte. Alternatively sodium peroxodisulfate can also be recovered in the known way, by reacting an anolyte containing ammonium peroxodisulfate from anodic oxidation of ammonium sulfate or ammonium hydrogen sulfate, with sodium hydroxide solution, then crystallising out the sodium peroxodisulfate and separating it from the mother liquor, see DE-OS 199 13 820 and DE-PS 27 57 861 for examples of the relevant embodiments.

In a similar way to sodium peroxodisulfate, potassium peroxodisulfate can also be produced using a solution containing potassium sulfate and ammonium sulfate or potassium hydrogen sulfate.

Figure 1:
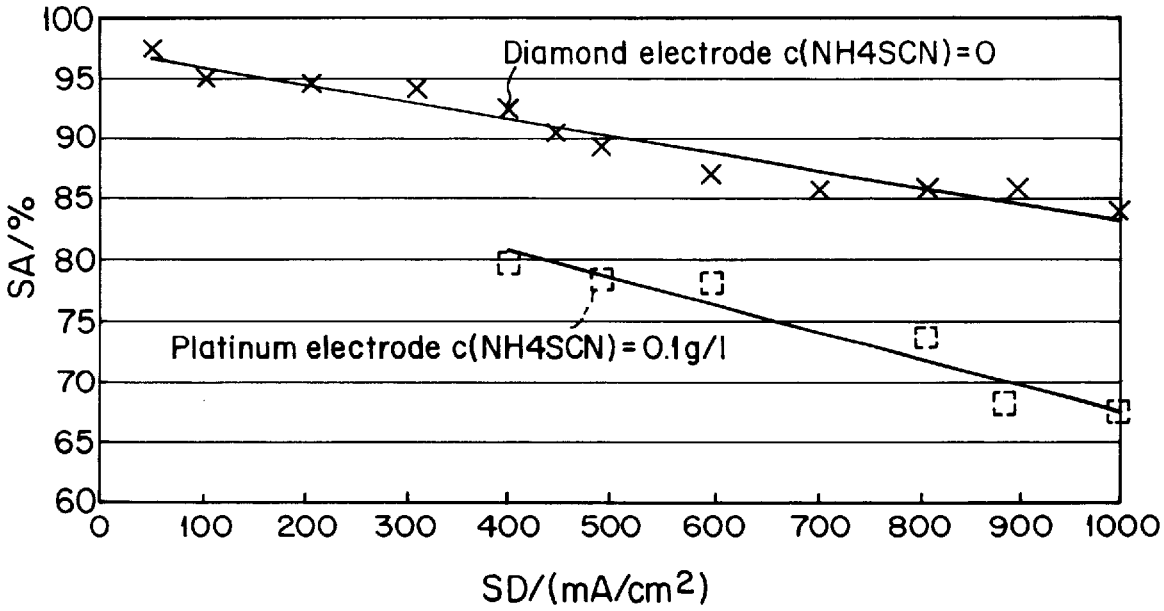
FIG. 1 shows the course of current efficiency as a function of current density when producing ammonium peroxodisulfate with a platinum electrode (comparative examples) and a diamond electrode doped with boron as used according to the invention.

It follows from FIG. 1 that, at a current density of 100 mA/cm$^2$, a current efficiency of 95% can be obtained. Although there is a reduction in current efficiency with the increase in current density, current efficiency at a current density of 1000 mA/cm$^2$ is still considerably higher than 80%. When using a conventional platinum anode, on the other hand, no ammonium peroxodisulfate at all can be recovered at low current densities and at higher current densities, the current efficiency is 10 to 20% lower than with a diamond electrode as used according to the invention.

Figure 2:
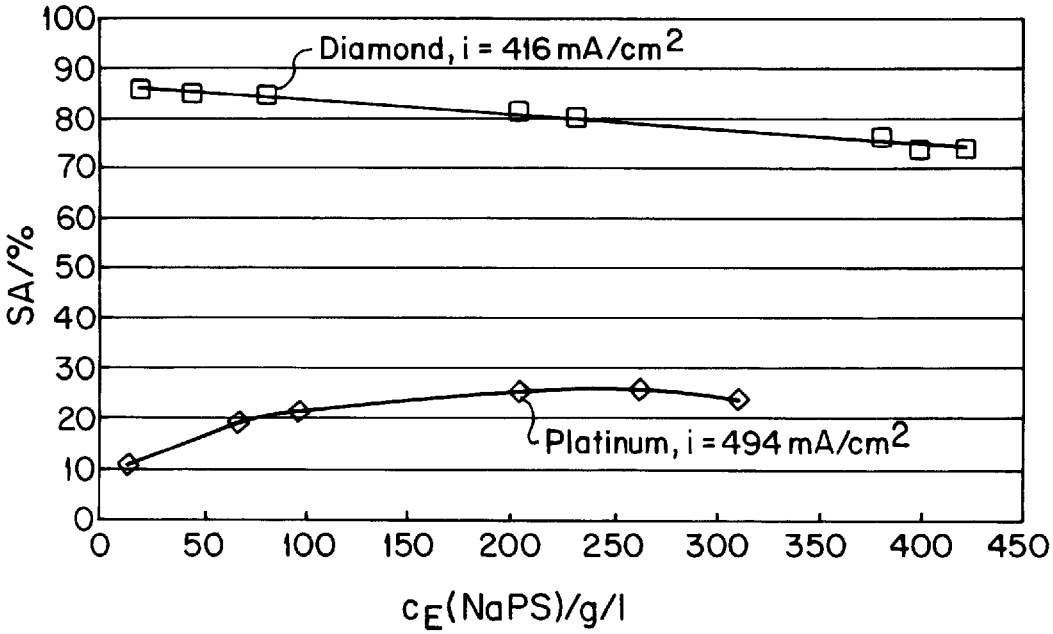
FIG. 2 uses the example of sodium peroxodisulfate at average current density to show the dependence of current efficiency on the concentration of sodium peroxodisulfate with a diamond or platinum electrode.

FIG. 2 shows that the current efficiency with a diamond electrode as used according to the invention falls only slowly as the content of sodium peroxodisulfate in the anolyte increases, under the test conditions anolyte solutions with a sodium peroxodisulfate content of about 400 g/l for example can be obtained at a current efficiency of equal to or greater than 75%. However, when using a conventional platinum anode and adding a promoter to the anolyte, it is only possible to obtain peroxodisulfate concentrations of about 300 g/l, and then at a current efficiency of about 25%.

It could not be foreseen that the process according to the invention, at high conversion levels with current densities which are manageable industrially, can be carried out up to high conversion levels at similarly high current efficiencies, without using a promoter. As, in the cited article by P. A. Michaud, on the one hand the formation of oxygen is mentioned as the main subsidiary reaction and on the other anodic oxidation of sulfuric acid at a maximum of 200 mA/cm$^2$ was carried out only at very low conversion levels, it was not to be expected that ammonium- and alkali metal peroxodisulfates could be produced simply and very economically by using a doped diamond anode. Apart from the fact that no promoter is used and thus the anode gas does not need to be cleaned, higher conversion levels and higher persulfate concentrations in the discharge anolyte can be obtained, which again reduces crystallisation costs. The working current density can be considerably reduced in relation to that required by platinum anodes, which results in fewer ohmic losses in the system, thus reducing the cooling costs and increasing the degree of freedom in the formation of the electrolytic cells and cathodes. A further advantage is that the conductive diamond anodes to be used according to the invention can be produced in any form and there are no corrodible joints such as welds and the like. This results in a longer electrode lifetime.

The invention is further explained by the following examples and comparative examples.

EXAMPLE 1 (E1) AND COMPARATIVE EXAMPLE 2 (CE1)

Production of Ammonium Peroxodisulfate

The electrolytic cell contains a lead cathode and a diamond anode doped with boron on an Si wafer. The diamond anode was bonded to a metal plate (current distributor). In the comparative example the diamond anode was replaced with a mirror-polished platinum foil ground with diamond dust. The electrolyte compartments were separated into an anode area and a cathode area using an ion exchange membrane (Nafion 430, DuPont). The distance between the electrodes was 2.2 cm. The circular electrode surface was 38.48 $cm^2$. The catholyte and anolyte were pumped in a circle, the catholyte volume being 2 l and the anolyte volume V=0.3 l.

The starting concentrations were:

catholyte: c(ammonium sulfate)=520 g/l c(sulfuric acid) =400 g/l anolyte c(ammonium sulfate)=400 g/l c(ammonium peroxodisulfate)=120 g/l The temperature of the apparatus was set at 45° C. The anolyte and catholyte were fed in a circle. During this process the anolyte was concentrated from $c_o$ (APS)=120 g/l to $C_e$(APS)=290 g/l. $(NH_4)_2S_2O_8$ was then crystallised out of the anolyte by vacuum distillation.

The following table shows the operating perameters and specific energy consumption.

The table shows the comparison of the electrolysis results with a platinum and a diamond anode

| No. | Electrode type | Promoter added (g/l) | Current density ($A/cm^2$) | Current efficiency (%) | Conversion level (%) | Specif. energy consumption (kWh/kg) |
|---|---|---|---|---|---|---|
| E 1 | doped diamond | 0.0 | 0.4 | 92.5 | 48 | 2.31 |
| | | 0.0 | 0.8 | 85.9 | 54 | 3.15 |
| | | 0.0 | 0.9 | 85.9 | 60 | 3.2 |
| CE 1 | platinum, polished | 0.1 | 0.4 | 79.7 | 47 | 2.74 |
| | | 0.1 | 0.8 | 73.6 | | 3.65 |
| | | 0.1 | 0.9 | 68.2 | 49 | 4.58 |
| | | 0.0 | 0.5 | 45.3 | | 4.4 |
| | | 0.0 | 0.8 | 33 | | 7.6 |

FIG. 1 shows the dependency of current efficiency on current density.

With comparable electrolysis conditions very poor results were achieved using a Pt anode without adding a conventional promoter. When ammonium rhodanide is added as a promoter, the results with Pt are still about 10–15% lower than those achieved with a diamond anode. When using a doped diamond electrode instead of a platinum electrode, the specific energy consumption at a current density of 0.9 $A/cm^2$ is about 30% lower and the conversion level is also considerably higher.

EXAMPLE 2 (E2) AND COMPARATIVE EXAMPLE 2 (CE2)

In the cell described previously (E1/CE1), $NaHSO_4$ was anodically oxidised. The anolyte consisted of an $NaHSO_4$ solution containing 610 g $NaHSO_4$/l. After setting the current density samples were taken and analysed after a given time. When calculating the current efficiency a linear reduction in volume was assumed.

The curves in FIG. 2 showed the current density as a function of the sodium peroxodisulfate (NaPS) concentration achieved in the anolyte using a diamond electrode (E2) or a platinum anode (CE2).

In CE2, according to the curve in FIG. 2, the anolyte contained no promoter. Current efficiencies approaching those of Example E 2 could only be achieved by using an anolyte with a prohibitively high concentration of promoter –0.6 g $NH_4SCN$/1.

What is claimed is:

1. A process for the production of a perozodisulfate of the series ammonium-, sodium- and potassium peroxodisulfate, comprising:

anodically oxidizing an aqueous electrolyte containing a salt of the series ammonium, sodium, potassium sulfate and/or of the corresponding hydrogen sulfate in an electrolytic cell comprising at least one anode, one cathode and one anolyte compartment, separated from a catholyte compartment by a separator or adjoining a gas diffusion cathode, wherein said anode comprises a conductive diamond film doped with a tri- or pentavalent element, mounted on a conductive carrier; and wherein the anolyte contains no added promoter.

2. The process according to claim 1, wherein said anode comprises a diamond film doped with boron, and said conductive carrier comprises silicon, germanium, titanium, zirconium, niobium, tantalum, tungsten or carbides thereof.

3. The process according to either claim 1 or claim 2, wherein:

said anolyte comprises an aqueous solution comprising 300 to 500 g ammonium sulfate per liter of anolyte and 0 to 0.2 mol sulfuric acid per mol of the ammonium sulfate;

said catholyte comprises a sulfur-acid ammonium sulfate solution;

said anodic oxidation is carried out at a current density in the range 50 to 1000 $mA/cm^2$.

4. The process according to claim 3 further comprising crystallizing out and separating said ammonium peroxodisulfate.

5. The process according to claim 3, wherein said separator comprises an ion exchange membrane.

6. The process according to claim 3, wherein said anolyte is a neutral anolyte.

7. The process according to claim 3, wherein said current density is in the range from 400 to 900 $mA/cm^2$.

8. The process according to either claim 1 or claim 2, wherein:

said cell comprises an anolyte compartment and catholyte compartment separated from each other by a separator;

said anolyte is a solution comprising 300 to 700 g sodium hydrogen sulfate per liter of anolyte;

said catholyte comprises a sulfur-acid hydrogen sulfate solution;

said anodic oxidation is carried out at a current density in the range 50 to 1000 $mA/cm^2$.

9. The process according to claim 8, wherein said separator comprises an ion exchange membrane.

10. The process according to claim 8, wherein said current density is in the range from 400 to 900 $mA/cm^2$.

* * * * *